US010225886B2

(12) United States Patent
Sugino

(10) Patent No.: US 10,225,886 B2
(45) Date of Patent: Mar. 5, 2019

(54) INFRARED LIGHT SOURCE

(71) Applicant: Mitsubishi Electric Corporation, Tokyo (JP)

(72) Inventor: Takaki Sugino, Tokyo (JP)

(73) Assignee: Mitsubishi Electric Corporation, Chiyoda-ku, Tokyo (JP)

( * ) Notice: Subject to any disclaimer, the term of this patent is extended or adjusted under 35 U.S.C. 154(b) by 292 days.

(21) Appl. No.: 15/075,285

(22) Filed: Mar. 21, 2016

(65) Prior Publication Data

US 2017/0156177 A1 Jun. 1, 2017

(30) Foreign Application Priority Data

Nov. 26, 2015 (JP) ..... 2015-230199

(51) Int. Cl.
*A45D 20/40* (2006.01)
*H05B 3/00* (2006.01)

(52) U.S. Cl.
CPC ..... *H05B 3/009* (2013.01); *H05B 2203/017* (2013.01)

(58) Field of Classification Search
None
See application file for complete search history.

(56) References Cited

U.S. PATENT DOCUMENTS 3,486,892 A * 12/1969 Rosvold ..... C23F 1/02 148/DIG. 106
3,769,562 A * 10/1973 Bean ..... B41J 2/34 148/DIG. 115
3,920,482 A * 11/1975 Russell ..... H01L 21/00 148/DIG. 115
4,766,671 A * 8/1988 Utsumi ..... B41J 2/1609 156/89.12
4,980,702 A * 12/1990 Kneezel ..... B41J 2/04541 338/308

(Continued)

FOREIGN PATENT DOCUMENTS

DE 10 2004 051 364 A1 6/2005
JP 07-282961 A 10/1995

(Continued)

OTHER PUBLICATIONS

Communication dated Sep. 27, 2016, from the Japanese Patent Office in counterpart Japanese application No. 2015-230199.

(Continued)

*Primary Examiner* — Thor Campbell
(74) *Attorney, Agent, or Firm* — Sughrue Mion, PLLC; Richard C. Turner

(57) ABSTRACT

An infrared light source includes a resistor formed on the side of one principal surface of a support substrate via an insulating film; a plurality of projections formed on the one principal surface side of the support substrate by etching the support substrate; and a protection film stacked as a layer on top of the resistor and projections. The resistor is disposed on the same plane in a region which forms an infrared emission portion in which the plurality of projections and the resistor are formed, and infrared is efficiently emitted from the region in which are formed the projections by heat generated by energizing the resistor.

8 Claims, 10 Drawing Sheets

(56) References Cited

U.S. PATENT DOCUMENTS

| | | | | |
|---|---|---|---|---|
| 5,210,549 | A * | 5/1993 | Takahashi | B41J 2/1604 148/DIG. 117 |
| 8,242,876 | B2 * | 8/2012 | Le Neel | H01C 17/265 257/519 |
| 2004/0142543 | A1 * | 7/2004 | Fukunaga | C23C 10/02 438/486 |
| 2004/0201447 | A1 * | 10/2004 | Wong | H01C 1/016 338/309 |
| 2007/0090293 | A1 | 4/2007 | Ichihara et al. | |
| 2012/0119872 | A1 * | 5/2012 | Leung | H01C 17/265 338/25 |
| 2016/0111579 | A1 * | 4/2016 | Shi | H01L 31/109 257/73 |

FOREIGN PATENT DOCUMENTS

| | | | |
|---|---|---|---|
| JP | 2001-221689 | A | 8/2001 |
| JP | 2005-140594 | A | 6/2005 |
| JP | 2005-221238 | A | 8/2005 |
| JP | 2006-013415 | A | 1/2006 |
| JP | 2013-210310 | A | 10/2013 |

OTHER PUBLICATIONS

L. Müller et al., "Silicon-Platinum nanostructures for high emissive surfaces in infrared hotplate emitters", Proceedings: Mikrosystemtechnik Kongress, 2013, Aachen, pp. 87 to 90 (total 4 pages).

Communication dated Jul. 23, 2018 from the German Patent and Trademark Office in counterpart Application No. 10 2016 206 381.2.

* cited by examiner

INFRARED LIGHT SOURCE

BACKGROUND OF THE INVENTION

1. Field of the Invention

The present invention relates to an infrared light source which emits infrared by generating heat by energizing a resistor.

2. Description of the Related Art

As a heretofore known infrared light source, a structure wherein a filament which forms a resistor is provided on single crystal silicon which is a support substrate, via an insulating film, is shown. Further, the infrared light source emits infrared using heat energy generated by energizing the filament. Furthermore, an infrared light source wherein the single crystal silicon immediately below the filament is etched away using bulk microelectromechanical systems (MEMS) and a heat generation portion is formed as a heat insulation structure, thus increasing energy efficiency, is proposed (for example, refer to PTL 1).

Also, an infrared light source wherein the single crystal silicon immediately below the heat generation portion of the infrared light source is etched away using the bulk MEMS, in the same way as in PTL 1, and the heat generation portion and an electrode pad provided on the support substrate side are electrically joined via a support body which forms a beam, thereby improving heat insulation characteristics, thus enhancing heat generation efficiency, is proposed (for example, refer to PTL 2).

However, the infrared light sources in PTLs differ in emissivity according to a filament material which forms a heat generation body or to the material of the resistor. Because of this, in order to produce a stable, high heat emission in an infrared wavelength region, it has been necessary to additionally provide an emissivity stabilizing member (for example, siliconit (PTL 1)), a highly emissive film (for example, carbon black, gold, platinum, chromium, or silicon carbide (PTL 2)), or the like.

That is, the infrared light source has heretofore needed two components; a heat generation portion and an emissivity stabilizing member or a highly emissive film, thus forming two-tier structure. Because of this, complex and special manufacturing steps have been necessary to obtain a desired function and performance. Furthermore, it is necessary to provide an emissivity stabilizing member or a highly emissive film in either structure in order to provide a highly efficient infrared light source, resulting in a structure which is not suitable for a reduction in the cost of the light source.

PTL 1: JP-A-2001-221689

PTL 2: JP-A-2005-140594

For each of the infrared light sources disclosed in PTLs 1 and 2, apart from a heat generation resistor (a filament (PTL 1), polycrystalline silicon or a metal material (PTL 2)), an emissivity stabilizing member (siliconit (PTL 1)) or a highly emissive film (carbon black, gold, platinum, chromium, or silicon carbide (PTL 2)) has been necessary, as a component to enhance emissivity, in order to carry out heat emission. Because of this, the structure of the infrared light source itself becomes complicated and thus is not suitable for a reduction in cost.

SUMMARY OF THE INVENTION

The invention, having been contrived in order to solve the heretofore described problems, has for its object to provide an infrared light source wherein it is possible to enhance emissivity, without additionally providing a film which contributes to a high emission, by devising the shape of the front surface of a region (an infrared emission portion) of the infrared light source from which infrared is emitted and providing projections on the front surface of the infrared emission portion.

An infrared light source according to the invention includes a support substrate; a resistor formed on the side of one principal surface of the support substrate via an insulating film; a plurality of projections formed on the one principal surface side of the support substrate; and a protection film stacked as a layer on top of the resistor and projections. The resistor is disposed on the same plane in a region of the support substrate in which the plurality of projections and the resistor are formed, and infrared is emitted by heat generated by energizing the resistor.

According to the infrared light source of the invention, the projections in the region (infrared emission portion) of the support substrate from which infrared is emitted change to black in a visible region, and it is possible to obtain a high emissivity close to that of a black body surface.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Embodiment 1

Figure 1:
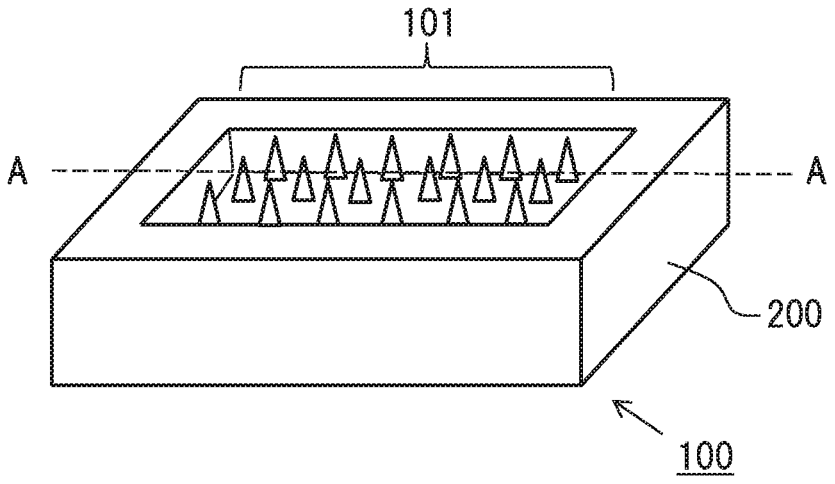
FIG. 1 is a perspective view of an infrared light source according to Embodiment 1 of the invention.

A description will be given, using FIGS. 1 to 3, of an infrared light source 100 of Embodiment 1 of the invention. FIG. 1 is a perspective view of the infrared light source 100 of Embodiment 1 of the invention. FIGS. 2A to 2D are sectional views showing a flow of manufacturing the infrared light source 100. Also, FIG. 3 is a sectional view showing a modification example of the infrared light source 100.

As shown in FIG. 1, the infrared light source 100 has a configuration wherein an infrared emission portion 101 is built-in on the side of one principal surface of a support substrate 200 formed of a bare silicon substrate. The infrared emission portion 101 is equivalent to a region on the support substrate 200 from which infrared is emitted. Further, the infrared emission portion 101 is built-in in a planar portion of a predetermined region on the support substrate 200. In the example of FIG. 1, the planar portion, which is dug down to a predetermined depth from the one principal surface on the upper side of the support substrate 200 as seen in the plane of FIG. 1, is patterned into a conductive layer, an insulating layer, and the like, thus forming the infrared emission portion 101 which emits infrared. Embodiment 2, to be described hereafter, shows an example wherein a predetermined region of the one principal surface which is the front surface of the support substrate 200 is defined as the planar portion in which to build in the infrared emission portion 101.

Further, a configuration which features the infrared light source 100 of the invention is a plurality of projections provided on the infrared emission portion 101. The projections are projection-shaped portions which jut out from the planar portion of the infrared emission portion 101 to the side toward which infrared is emitted, and are formed to a state in which the plurality of projections jut out from the planar portion. Further, a structure wherein the projections are provided on the infrared emission portion 101, thereby roughening the front surface of the infrared emission portion 101, is adopted.

In the infrared light source 100, the plurality of projections are provided on the front surface of the infrared emission portion 101 in order to add to the infrared emission portion 101 a function equal to that of a highly emissive film or emissivity stabilizing member. The projections provided on the front surface of the infrared emission portion 101 change to black in a visible region, and the portion in which the projections are provided attains the emissivity close to that of a black body surface. That is, it is easy to achieve the balance between an enhancement in the performance, and a simplification in the structure, of the infrared light source 100, without using a highly emissive film or emissivity stabilizing member, and it is possible to obtain the infrared light source 100 which has a high sensitivity and is easy to manufacture.

A bonding pad portion which is electrically bonded to a resistor formed in the infrared emission portion 101 exists in a region of the support substrate 200 other than the infrared emission portion 101, but as the present application is of the invention relating to the structure of the infrared emission portion 101, the description of the bonding pad portion is omitted from the drawings.

Next, a detailed description will be given, using FIGS. 2A to 2D, of a method of manufacturing the infrared light source 100 of Embodiment 1 shown in FIG. 1 and a sectional structure of the infrared emission portion 101.

FIGS. 2A to 2D are diagrams, showing a manufacturing flow, which show the A-A section of the infrared light source 100 of 1. FIGS. 2A to 2D show manufacturing steps from FIG. 2A to FIG. 2D, and a sectional structure of the infrared light source 100 to be finally obtained corresponds to FIG. 2D. The steps of manufacturing the infrared light source 100 will hereafter be described in order.

Figure 2A:
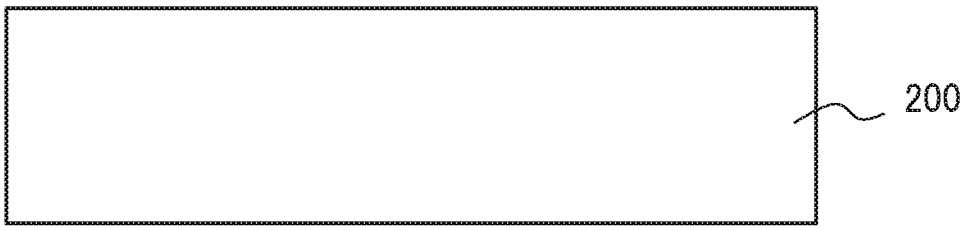
FIGS. 2A to 2D are diagrams showing a flow of manufacturing the infrared light source of Embodiment 1 of the invention, wherein the infrared light source is manufactured in the order of the steps of FIGS. 2A, 2B, 2C, and 2D.
Figure 3:
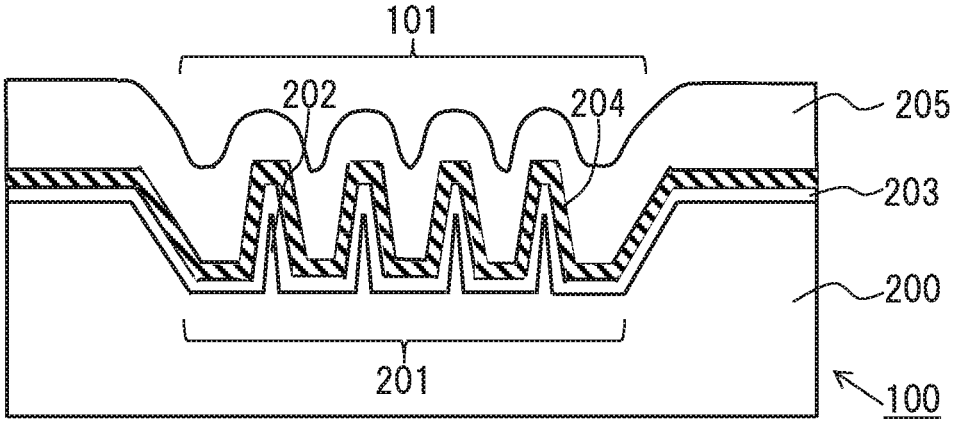
FIG. 3 is a diagram showing a modification example of the infrared light source of Embodiment 1 of the invention.

Firstly, in the step of FIG. 2A, a bare silicon substrate is prepared as the support substrate 200.

Figure 2B:
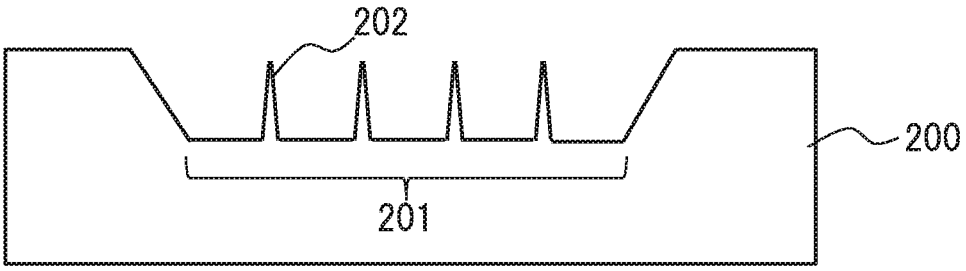

Next, in the step of FIG. 2B, projections 202 are formed, and a planar portion 201 in which to form a metal wiring layer which forms the resistor is formed, in a region of the support substrate 200 in which to build in the infrared emission portion 101. In this step, the projections 202 are formed at the same time as the formation of the planar portion 201 using, for example, a photoengraving technique. Specifically, a resist pattern is formed on the one principal surface of the support substrate 200, and the support substrate 200 is selectively etched away with the resist pattern as an etching mask, thereby leaving the projections 202, which are formed of silicon columnar structures, in positions immediately below the etching mask, and the other region is dug down to a predetermined depth, thus forming the planar portion 201 in which to build in the resistor and the like. That is, the front surface of the planar portion 201 obtained on the one principal surface side of the support substrate 200 is dug down to a predetermined depth from the one principal surface of the support substrate 200 toward the inner side of the substrate, and the plurality of projections 202 jutting out from the front surface of the planar portion 201 are formed to a height of up to the height of the one principal surface of the support substrate 200.

As a dry etching method carried out in the step shown in FIG. 2B, there is, for example, silicon deep etching using an inductively coupled plasma (ICP) etching device Furthermore, by optimizing the etching conditions, it is also possible to form the projections 202 without using a resist mask.

Figure 2C:
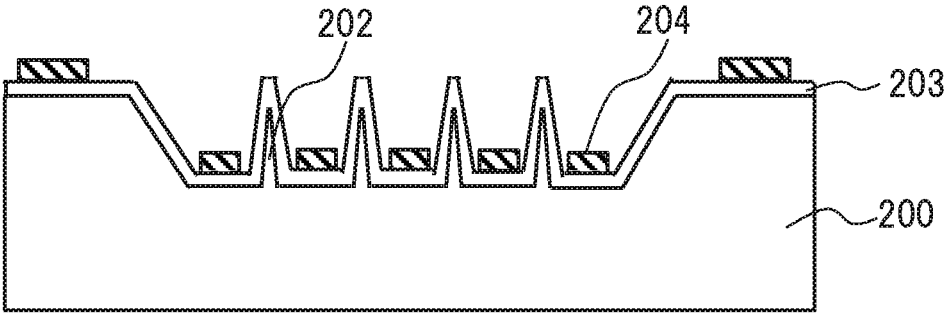

Subsequently, the step of FIG. 2C follows. In the step of FIG. 2C, an insulating film 203 is deposited on the upper surface of the support substrate 200 so as to cover the projections 202 formed in the step of FIG. 2B. The insulating film 203 is a silicon nitride film, a silicon oxide film, or the like which is formed using, for example, a chemical vapor deposition (CVD) method, and also has a function as a protection film. Next, a resistor 204, which is a metal wiring layer which generates heat by being energized, is formed directly as a layer on top of the insulating film 203 by patterning. In this patterning step, a conductive film deposited as a layer on the insulating film 203 can be processed into the resistor 204 of a predetermined shape using a photoengraving technique or the like whereby the other portion is etched away leaving only a portion of the conductive film which forms the metal wiring layer (an electrode). Herein, the material of the resistor 204 which forms the metal wiring layer is not particularly limited as long as the material is a high melting point metallic material such as titanium or chromium, and furthermore, is a silicon film having a relatively low resistance, or the like.

In the infrared emission portion 101, as the resistor 204 is formed on the same plane, it is possible to pattern the resistor 204 with good precision, compared with when patterning the resistor 204 onto an uneven surface portion, and thus possible to stabilize an energized state after the infrared light source 100 is completed.

Subsequently, the step of FIG. 2D follows. In the step shown in FIG. 2D, a protection film 205 (a passivation film) is formed so as to cover the whole of the infrared light source 100 including a signal processing circuit portion (not shown), thus completing the infrared emission portion 101 of the infrared light source 100.

The protection film 205 formed at this stage is, for example, a silicon nitride film and can be formed by a CVD method. The silicon nitride film which forms the protection film 205 is formed for the purpose of protecting the infrared light source 100 against a physical floating matter, such as a foreign matter, or blocking the moisture in the atmosphere. The protection film 205 is not limited to the silicon nitride film as long as the film is made of a material having the same function. The silicon nitride film has the characteristics of absorbing a specific band of wavelength. Because of this, the protection film 205 is used by being formed into as thin a film as possible only to the extent not to impair the heretofore mentioned kind of function as a protection film. It goes without saying that the material which can be used for the protection film 205 is not limited to the silicon nitride film, and that no particular limitation is placed on the material as long as the material has a high transmission in an infrared region and does not impair the function as a protection film.

In this way, the infrared light source 100 is completed.

The infrared light source 100 of Embodiment 1 of the invention is of a structure wherein after the projections 202 formed of silicon columnar structures are formed in the planar portion 201 of the support substrate 200 which forms the infrared emission portion 101, and the front surface of the support substrate 200 is covered with the insulating film 203, the conductive film (metal layer) is stacked on the insulating film 203 and patterned into a predetermined pattern, thus forming the resistor 204, and the resistor 201 is covered with the protect ion film 205.

In the structure, when the resistor 204 generates heat by being energized, the heat transfers to the side of the projection s 202, thus emitting infrared, and it s possible to enhance emissivity compared with in an infrared light source of a structure wherein no projection 202 is formed.

That is, in the structure, there is no more need for a highly emissive film or emissivity stabilizing member which has heretofore been necessary. Further, it is possible to achieve the balance between an enhancement in the performance, and a simplification in the structure, of the infrared light source 100, and thus possible to provide an infrared light source which has a high performance and is easy to manufacture.

Figure 2D:
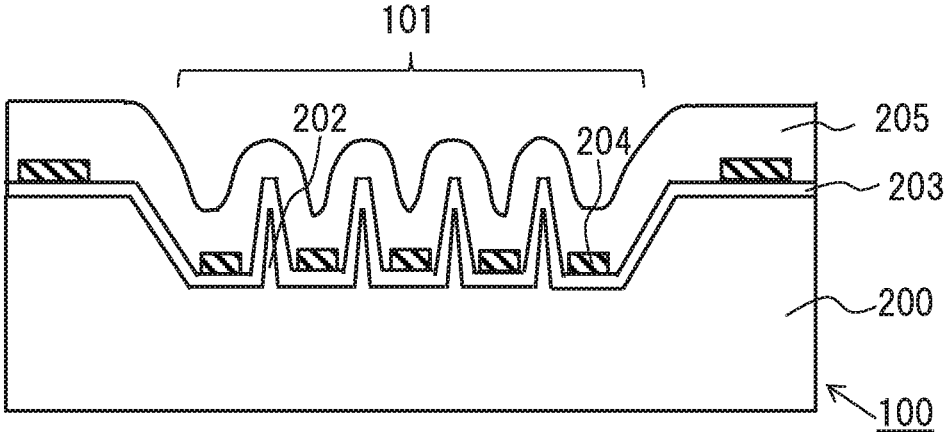

The structure of the infrared light source 100 of Embodiment 1 shown in FIG. 2D can also be used by being changed in the way as shown in FIG. 3. That is, in the example of FIG. 2D, the resistor 204 is distributed in the region of the planar portion 201 in which no projection 202 is formed, but it is also good to attain a condition wherein the resistor 204 is also formed in the region in which the projections 202 are formed, and covers the whole of the projections 202, as shown in the sectional view of FIG. 3. Even with the infrared light source 100 of FIG. 3, it is possible to obtain advantageous effects equivalent to those of the infrared light source 100 of FIGS. 2A to 2D. Furthermore, even when a structure is adopted wherein the resistor 204 covers one portion of the plurality of projections 202, although not shown, it is possible to obtain advantageous effects equivalent to those of the infrared light source 100 of FIGS. 2A to 2D.

Herein, the infrared light source 100 obtained in the invention can be used as a light source of, for example, an infrared detection sensor such as an infrared gas analyzer which carries out measurement using infrared, and can also be used as a light source aiming at heating with infrared.

Embodiment 2

Next, a description will be given, using FIGS. 4A to 4D and 5, of an infrared light source 100 of Embodiment 2 of the invention.

In Embodiment 1, a description has been given of the example wherein the infrared emission portion 101 is built-in in the planar portion 201 dug down to a predetermined depth from the one principal surface of the support substrate 200. In Embodiment 2, a predetermined region of the one principal surface of the support substrate 200 is used by being set as the planar portion 201 without etching the substrate. Further, rather than forming the projections 202 by selectively removing the substrate, a feature is such that projections are formed by forming protuberances, which produce the same advantageous effect as the projections, on the upper surface of the insulating film 203 or resistor 204 stacked on the one principal surface of the support substrate 200. Projections formed on the front surface of an insulating film 400 are shown as protuberances 401 in FIGS. 4B to 4D, and projections formed on the front surface of the resistor 204 are shown as protuberances 204*a* in FIG. 5.

Next, a detailed description will be given, using FIGS. 4A to 4D, of a method of manufacturing the infrared light source 100 of Embodiment 2 wherein the infrared emission portion 101 is built-in in the one principal surface of the support substrate 200, and of a sectional structure of the infrared emission portion 101.

FIGS. 4A to 4D are diagrams, showing a manufacturing flow, which show sections equivalent to the A-A portion of the infrared light source 100 of FIG. 1. FIGS. 4A to 4D show manufacturing steps from FIG. 4A to FIG. 4D, and a sectional structure of the infrared light source 100 to be finally obtained corresponds to FIG. 4D. The steps of manufacturing the infrared light source 100 of Embodiment 2 will hereafter be described in order.

Figure 4A:
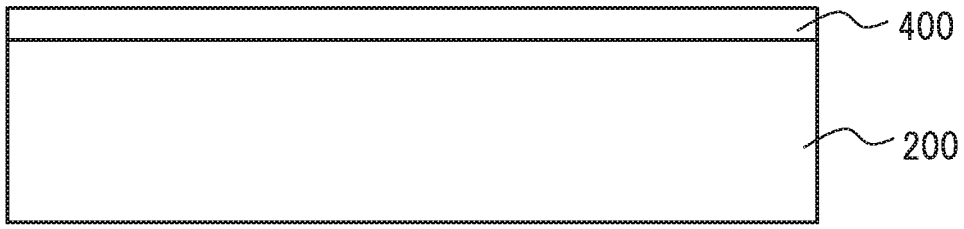
FIGS. 4A to 4D are diagrams showing a flow of manufacturing an infrared light source of Embodiment 2 of the invention, wherein the infrared light source is manufactured in the order of the steps of FIGS. 4A, 4B, 4C, and 4D.

Firstly, in the step of FIG. 4A, a bare silicon substrate is prepared as the support substrate 200. Further, in order to secure the electrical insulation between the support substrate 200 and the resistor 204 to be formed in the following step, a silicon nitride film or a silicon oxide film is deposited as the insulating film 400 on the one principal surface of the support substrate 200 using a CVD method or the like. Herein, the insulating film 400 is not limited to the silicon nitride film or silicon oxide film as long as the material can secure the electrical insulation. Also, the method of depositing the insulating film 400 is also not limited to a CVD method, and there is no problem either in using, for example, a heat treatment method or a sputtering method.

Figure 4B:
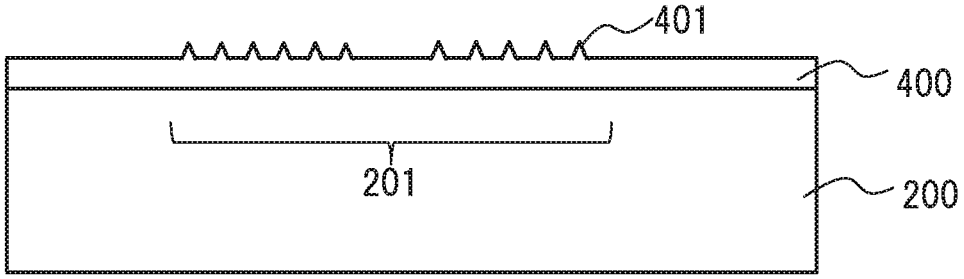

Next, the step of FIG. 4B follows. In the step of FIG. 4B, surface treatment is implemented on a region of the planar portion 201, which forms the infrared emission portion 101 of the insulating film 400 deposited on the one principal surface of the support substrate 200 in the step of FIG. 4A, using, for example, an ion beam etching (IBE) technique. In the surface treatment of the insulating film 400 by an IBE device, by physically processing the region by ion irradiation, a large number of slightly jutting out protuberances 401 (which are micro-projections and equivalent to projections) are formed on the front surface of the insulating film 400.

In this way, the micro-protuberances 401 are provided on the front surface of the insulating film 400 in the planar portion 201 which forms the infrared emission portion 101.

In the heretofore described example, the surface treatment by the IBE device has been illustrated as an example of the processing treatment for forming projections, but the processing treatment is not limited to IBE treatment, and there is no problem either in using another technique as long as the technique is a technique, such as sandblasting, whereby micro-projections can be formed by roughening the front surface of the insulating film 400.

Figure 4C:
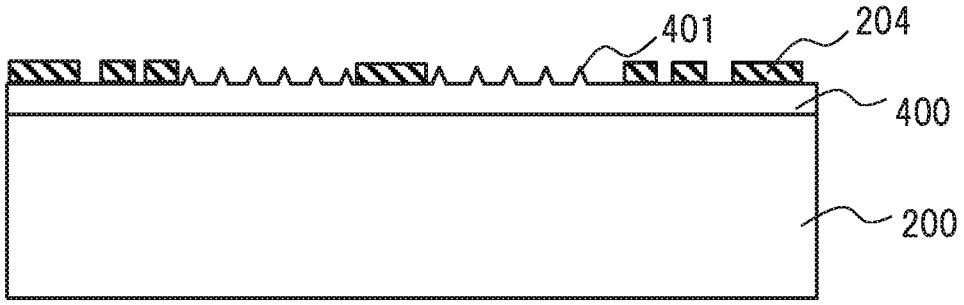

Subsequently, the step of FIG. 4C follows. In the step of FIG. 4C, a metal layer which forms the resistor 204 of the infrared light source 100 is deposited by a sputtering method, and selectively processed into a desired pattern, with a resist as an etching mask, using, for example, a photoengraving technique. Herein, the material and deposition of the resistor 204 are not particularly limited as long as the material is a silicon film having a relatively low resistance, or the like, apart from a high melting point metallic material such as titanium or chromium.

Subsequently, the step of FIG. 4D follows. In the step FIG. 4D, the protection film 205 is stacked so as to cover the whole of the one principal surface side of the support substrate 200 of the infrared light source 100, thus completing the infrared emission portion 101 of the infrared light source 100. The protection film 205 can be formed by, for example, depositing a silicon nitride film using a PVC method, as shown in Embodiment 1, and can also be configured of another material having the same nature.

In this way, it is possible to obtain the infrared light source 100 with the infrared emission portion 101 built-in on the one principal surface of the support substrate 200.

In this way, with the infrared light source 100 of Embodiment 2 of the invention, it is possible to form the large number of protuberances 401 (which are micro-projections and equivalent to projections) by treating the front surface of the insulating film 400 deposited on the infrared emission portion 101 of the support substrate 200.

As shown in FIG. 4C, the protuberances 401 are provided in a region of the planar portion 201, which forms the infrared emission portion 101, other than a region on the insulating film 400 in which to form the resistor 204. In this structure, it is possible to enhance infrared emissivity by the protuberances 401 being formed on the front surface of the insulating film 400 without using a highly emissive film or emissivity stabilizing member which has heretofore been necessary. That is, according to Embodiment 2 too, it is possible to achieve the balance between an enhancement in the performance, and a simplification in the structure, of the infrared light source 100, and thus possible to provide an infrared light source which has a high performance and is easy to manufacture, in the same way as in Embodiment 1.

Figure 4D:
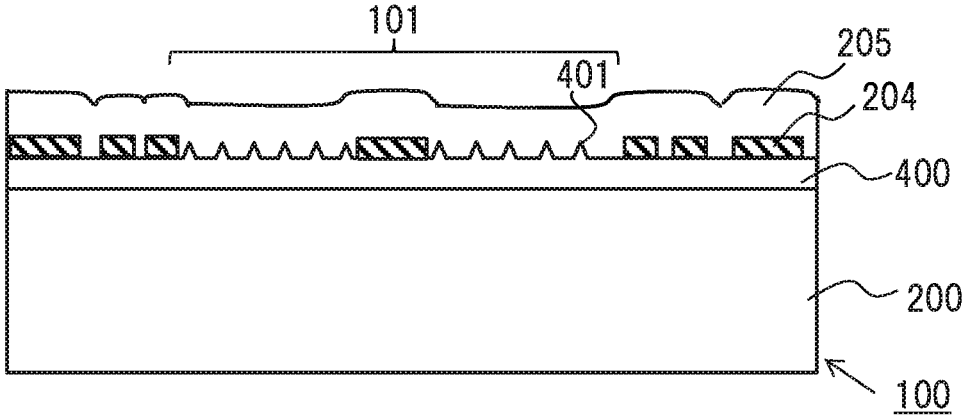
Figure 5:
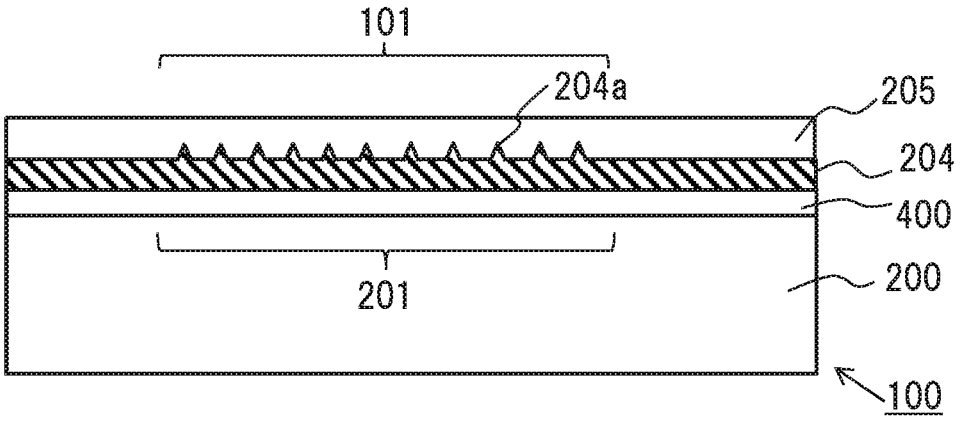
FIG. 5 is a diagram showing a modification example of the infrared light source of Embodiment 2 of the invention.

Also, the structure of the infrared light source 100 of Embodiment 2 shown n FIG. 4D can also be used by being changed in the way as shown in FIG. 5. FIG. 5 is a sectional view showing a modification example of the infrared light source 100 of Embodiment 2. In the example of FIG. 4D, the protuberances 401 equivalent to projections are formed on the upper surface of the insulating film 400, but in the modification example, the protuberances 204*a* (micro-projections) equivalent to projections are formed on the upper surface of the resistor 204 by processing the front surface of the resistor 204 into a rough surface, as shown in the sectional view of FIG. 5. It goes without saying that when the protuberances 204*a* which form projections are formed on the upper surface of the resistor 204, it is possible to enhance emissivity compared with when no protuberance 204*a* is formed.

Also, the protuberances 401 and the protuberances 204*a* can also be used by being combined, and after the protuberances 204*a* are formed as projections on the upper surface of the resistor 201, the protuberances 401 are formed on the upper surface of the insulating film 400, as shown in FIG. 4D, and by roughening both the respective front surfaces of the insulating film 400 and resistor 204, it is possible to enhance infrared emissivity compared with when one of the two front surfaces is roughened.

Embodiment 3

In Embodiments 1 and 2, a description has been given of the structure wherein the emissivity of the infrared light source 100 is enhanced by forming the infrared emission portion 101 having the projections on the one principal surface side of the support substrate 200.

In Embodiment 3, a description will be given, using FIGS. 6 to 11, of a modification example wherein it is possible to more enhance the emission efficiency of the infrared light sources 100 of Embodiments 1 and 2. An infrared light source 100 of Embodiment 3, being characterized in that a void portion 206 is formed immediately below a portion of the support substrate 200 which forms the infrared emission portion 101, adopts a heat insulation structure which enhances the efficiency of heat generation by energizing the resistor 204 and suppresses heat transfer.

The basic configuration of the infrared light source 100 in Embodiment 3 is the same as the structures and manufacturing methods described in Embodiments 1 and 2. In Embodiment 3, a description will be given focusing attention on modifications of Embodiments 1 and 2.

The infrared light source 100 of Embodiment 3 of the invention is such that the void portion 206 is formed in a region of the support substrate 200 which is immediately below the infrared emission portion 101 using, for example, tetramethylammonium hydroxide (TMAH), in the way as shown in FIGS. 6 to 11.

The depth of the void portion 206 formed in the portion of the support substrate 200 below the infrared emission portion 101 may be any depth, and no particular limitation is placed on the depth, as long as the depth is such that the infrared emission portion 101 and the support substrate 200 can be separated. Furthermore, the method of etching the support substrate 200 is also not limited to using TMAH, and there is no problem either in using a dry etching method using fluorine-based gas or the like.

Figure 6:
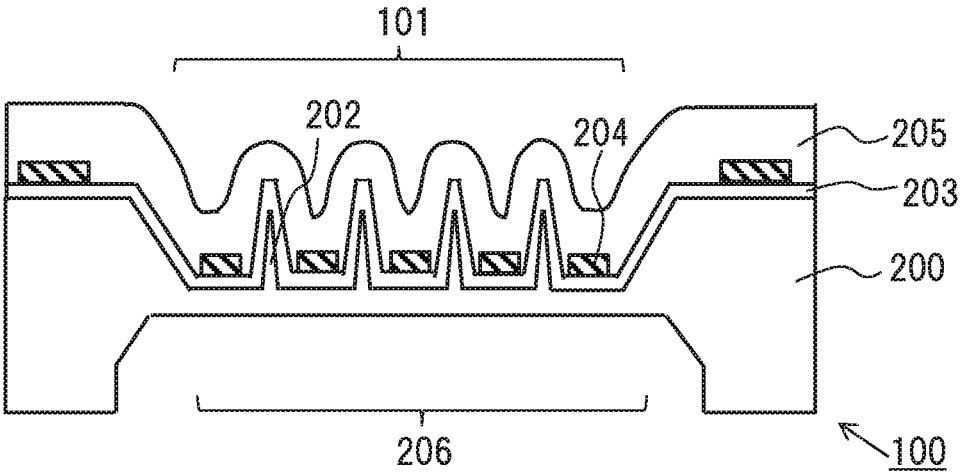
FIG. 6 is a diagram showing an infrared light source of Embodiment 3 of the invention.

FIG. 6 shows a sectional view when a void portion 206 is formed in the infrared light source 100 shown in FIGS. 2A to 2D of Embodiment 1. Further, in FIG. 6, by the support substrate 200 being etched by a method, such as using TMAH, from the rear surface side of the support substrate 200 toward the one principal surface side from which infrared is emitted, the void portion 206 provided in the support substrate 200 is formed to a depth which does not reach the one principal surface side of the support substrate 200.

Herein, it is described in Embodiment 1 that the bare silicon substrate is used as the support substrate 200, but when a silicon-on-insulator (SOI) substrate is used in place of the bare silicon substrate, a BOX layer (an embedded oxide film) of the SOI substrate serves as an etching stopper, thus obtaining the advantageous effect that it is easy to manufacture the support substrate 200.

Figure 7:
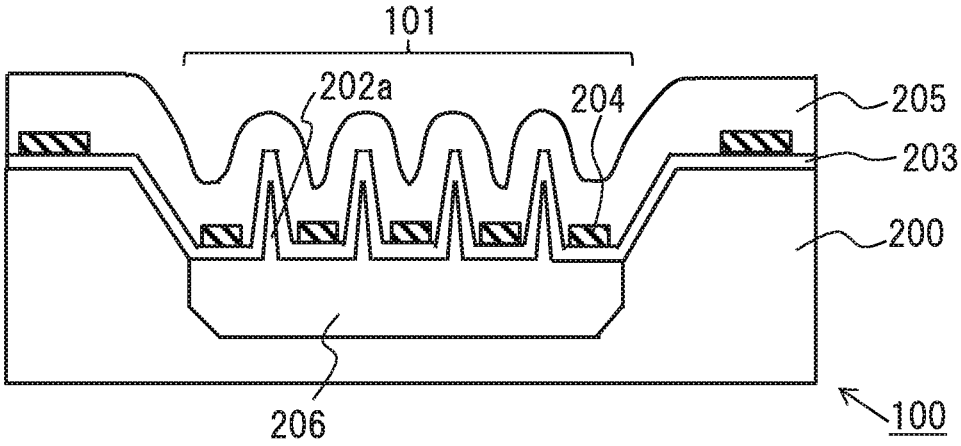
FIG. 7 is a diagram showing a modification example of the infrared light source of Embodiment 3 of the invention.

FIG. 7 shows a sectional view when a void portion 206 is formed, from a direction different from in FIG. 6, in the infrared light source 100 shown in FIGS. 2A to 2D of Embodiment 1. Further, in FIG. 7, by the support substrate 200 being etched by a method, such as using TMAH, toward the rear surface side from the one principal surface side from which infrared is emitted, the void portion 206 provided in the support substrate 200 is formed to a depth which does not reach the rear surface side of the support substrate 200.

The projections 202 formed by etching the support substrate 200 have been used as basic shape portions when stacking the insulating film 203 and protection film 205, but after the films are formed, are removed when forming the void portion 206, and formed into projection-shaped void portions 202*a*. Even after the projections 202 are removed, there is no change in the structure wherein the insulating film 203 and protection film 205 jutting out in the form of projections are provided in the infrared emission portion 101, and it is possible to obtain the infrared light source 100 which can realize efficient infrared emission, in the same way as in FIG. 6.

Figure 8:
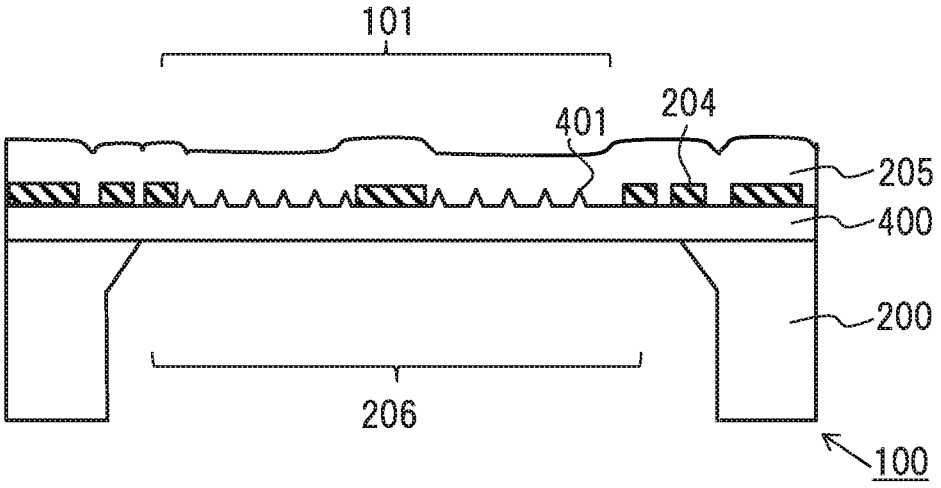
FIG. 8 is a diagram showing a modification example of the infrared light source of Embodiment 3 of the invention.

FIG. 8 shows a sectional view when a void portion 206 is formed, in the infrared light source 100 shown in FIGS. 4A to 4D of Embodiment 2, to a state in which the void portion 206 passes through the support substrate 200 from the one principal surface side to the rear surface side of the support substrate 200. In this way, even by etching away the region of the support substrate 200, in which to form the infrared emission portion 101, to a state in which the void portion 206 passes through the support substrate 200, it is possible to suppress the heat transfer to the support substrate 200, and to enhance infrared emissivity by an amount equal to the extent to which it is possible to enhance heat generation efficiency, compared with in Embodiment 2.

Figure 9:
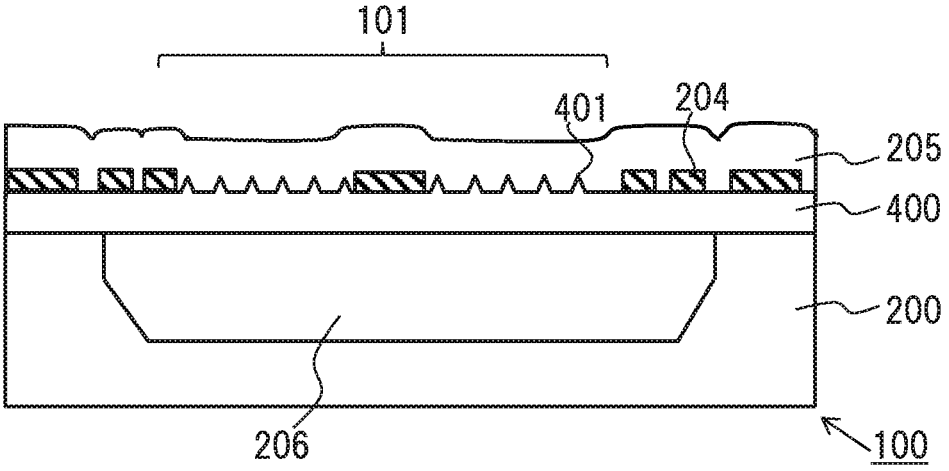
FIG. 9 is a diagram showing a modification example of the infrared light source of Embodiment 3 of the invention.

FIG. 9 shows a sectional view when a void portion 206 is formed, in the infrared light source 100 shown in FIGS. 4A to 4D of Embodiment 2, to a different state from in FIG. 8. Further, in FIG. 9, by the support substrate 200 being etched by a method, such as using TMAH, from the one principal surface side, from which infrared is emitted, toward the rear surface side of the support substrate 200, the void portion 206 provided in the support substrate 200 is formed to a depth which does not reach the rear surface side of the support substrate 200.

Figure 10:
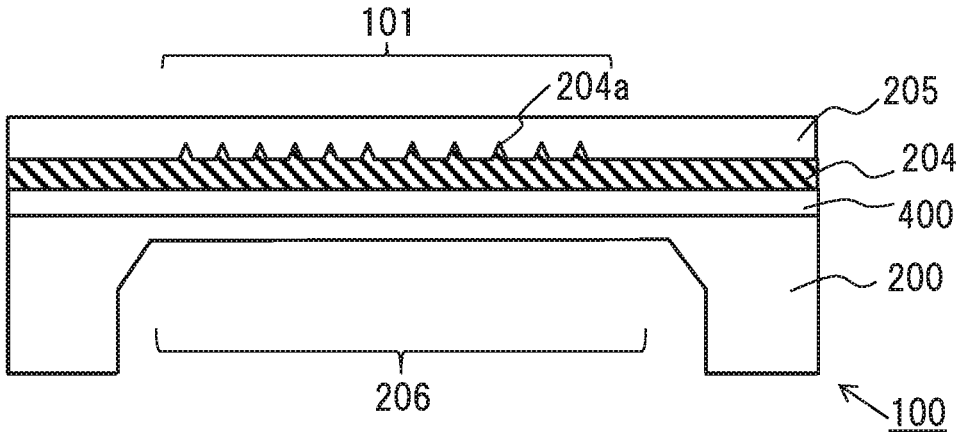
FIG. 10 is a diagram showing a modification example of the infrared light source of Embodiment 3 of the invention.

FIG. 10 shows a sectional view when a void portion 206 of a shape in which the void portion 206 is dug down to a depth, which does not reach the one principal surface, from the rear surface side toward the one principal surface side of the support substrate 200, is formed in the infrared light source 100 shown in FIG. 5 of Embodiment 2. The void portion 206 shown in FIG. 10 can be formed by etching the support substrate 200 from the rear surface side of the support substrate 200 using a method such as using TMAH.

Furthermore, it is possible to mate it easier to manufacture the infrared light source 100 shown in FIG. 10 by using an SOI substrate as the support substrate 200 in the same way as the infrared light source 100 shown in FIG. 6.

Figure 11:
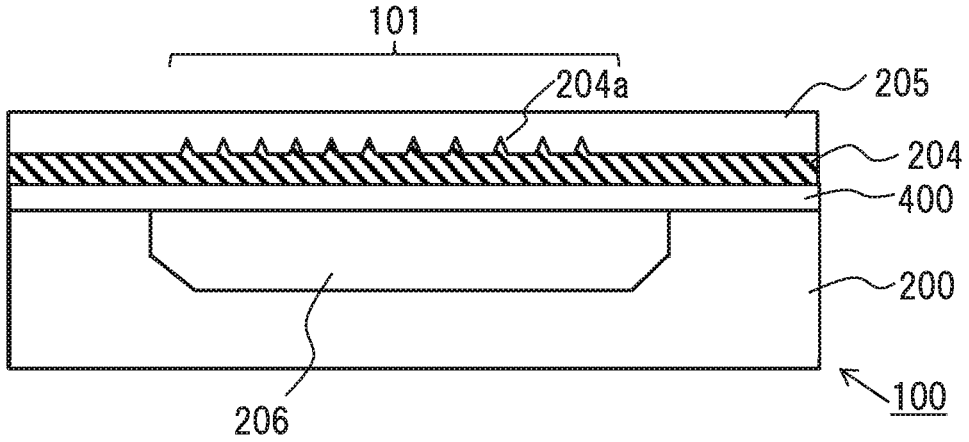
FIG. 11 is a diagram showing a modification example of the infrared light source of Embodiment 3 of the invention.

FIG. 11 is a sectional view of the infrared light source 100 shown in FIG. 5 of Embodiment 2 and shows a condition in which is formed a void portion 206 of a shape in which the void portion 206 is dug down to a depth, which does not reach the rear surface, from the one principal surface side toward the rear surface side of the support substrate 200. As shown in FIG. 11, the void portion 206 can be formed by etching the support substrate 200 from the one principal surface side using a method such as using TMAH.

Each of the infrared light sources 100 shown in FIGS. 6 to 11 is such that the void portion 206 is formed by etching away a portion of the support substrate 200 positioned below the infrared emission portion 101 which is the region from which infrared is emitted. Therefore, as it is possible to suppress heat transfer and thus possible to enhance heat generation efficiency, it is possible to enhance infrared emissivity, compared with in an infrared light source with no void portion 206 formed in the support substrate 200.

Therefore, it is possible to provide an infrared light source which has a high performance and is easy to manufacture, compared with a heretofore known infrared light source.

The invention is such that the individual embodiments can be freely combined, and any of the individual embodiments can be appropriately modified or omitted, without departing from the scope of the invention.

Various modifications and alterations of this invention will be apparent to those skilled in the art without departing from the scope and spirit of this invention, and it should be understood that this is not limited to the illustrative embodiments set forth herein.

What is claimed is:

1. An infrared light source comprising:

a support substrate;

a resistor formed on the side of one principal surface of the support substrate via an insulating film;

a plurality of projections formed on the one principal surface side of the support substrate; and a protection film stacked as a layer on top of the resistor and projections, wherein the resistor is disposed on the same plane in a region in which the plurality of projections and the resistor are formed, and infrared is emitted by heat generated by energizing the resistor, and wherein the resistor is disposed on a flat planar surface of the insulating film between the plurality of projections.

2. The infrared light source according to claim 1, wherein the projections are columnar bodies formed to a state in which a region, of a region of the support substrate from which infrared is emitted, other than the projections is dug down to a depth equivalent to the height of the projections from the one principal surface.

3. The infrared light source according to claim 1, wherein the projections are basic shape portions when stacking the insulating film and protection film, and are projection-shaped void portions formed by removing the basic shape portions after forming the insulating film and protection film.

4. The infrared light source according to claim 1, wherein an SOI substrate is used as the support substrate.

5. The infrared light source according to claim 1, wherein a void portion is provided below the region of the support substrate from which infrared is emitted.

6. An infrared light source comprising:

a support substrate;

a resistor formed on the side of one principal surface of the support substrate via an insulating film;

a plurality of projections formed on the one principal surface side of the support substrate; and a protection film stacked as a layer on top of the resistor and projections, wherein the resistor is disposed on the same plane in a region in which the plurality of projections and the resistor are formed, and infrared is emitted by heat generated by energizing the resistor, wherein the resistor is disposed on a flat planar surface of the insulating film between the plurality of projections, wherein a void portion is provided below the region of the support substrate from which infrared is emitted, and wherein the void portion provided in the support substrate, by being dug down from the one principal surface side of the support substrate, is formed to a depth which does not reach the rear surface side.

7. An infrared light source comprising:

a support substrate;

a resistor formed on the side of one principal surface of the support substrate via an insulating film;

a plurality of projections formed on the one principal surface side of the support substrate; and a protection film stacked as a layer on top of the resistor and projections, wherein the resistor is disposed on the same plane in a region in which the plurality of projections and the resistor are formed, and infrared is emitted by heat generated by energizing the resistor, wherein the resistor is disposed on a flat planar surface of the insulating film between the plurality of projections, wherein a void portion is provided below the region of the support substrate from which infrared is emitted, and wherein the void portion provided in the support substrate is formed to a state in which the void portion passes through the support substrate from the one principal surface side to the rear surface side of the support substrate.

8. The infrared light source according to claim 5, wherein the void portion provided in the support substrate, by being dug down from the rear surface side of the support substrate, is formed to a depth which does not reach the one principal surface side.

* * * * *